US010641134B2

(12) United States Patent
Bucher et al.

(10) Patent No.: US 10,641,134 B2
(45) Date of Patent: May 5, 2020

(54) WASTE-HEAT RECOVERY SYSTEM

(71) Applicant: Mahle International GmbH, Stuttgart (DE)

(72) Inventors: Michael Bucher, Berlin (DE); Michael Hoetger, Berlin (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 16/315,567

(22) PCT Filed: Jul. 5, 2017

(86) PCT No.: PCT/EP2017/066740
§ 371 (c)(1),
(2) Date: Jan. 4, 2019

(87) PCT Pub. No.: WO2018/007432
PCT Pub. Date: Jan. 11, 2018

(65) Prior Publication Data

US 2019/0301311 A1 Oct. 3, 2019

(30) Foreign Application Priority Data

Jul. 5, 2016 (DE) ..... 10 2016 212 232

(51) Int. Cl.
*F01K 27/02* (2006.01)
*F01K 3/12* (2006.01)
(Continued)

(52) U.S. Cl.
CPC ..... *F01K 27/02* (2013.01); *F01K 3/12* (2013.01); *F01K 9/003* (2013.01); *F01K 9/023* (2013.01);
(Continued)

(58) Field of Classification Search
CPC ..... F01K 27/02; F01K 13/006; F01K 9/023; F01K 3/12
See application file for complete search history.

(56) References Cited

U.S. PATENT DOCUMENTS

| | | | |
|---|---|---|---|
| 7,594,399 | B2 | 9/2009 | Lehar et al. |
| 2013/0199173 | A1 | 8/2013 | Voss et al. |
| 2015/0275778 | A1 | 10/2015 | Fast et al. |

FOREIGN PATENT DOCUMENTS

| | | | |
|---|---|---|---|
| DE | 136280 | A1 | 6/1979 |
| DE | 10226445 | C1 | 6/2003 |

(Continued)

OTHER PUBLICATIONS

English Translation DE 102009050068 A1 (Year: 2011).*

(Continued)

*Primary Examiner* — Mark A Laurenzi
*Assistant Examiner* — Shafiq Mian
(74) *Attorney, Agent, or Firm* — Fishman Stewart PLLC

(57) ABSTRACT

A waste-heat recovery system may include a waste-heat recovery circuit in which a working fluid is circulatable and which has a high pressure region and a low pressure region. The system may also include a conveying device configured to drive the working fluid, a steam generator configured to evaporate the working fluid, an expansion machine configured to expand the working fluid via mechanical work, at least one condenser configured to condense the working fluid, a container arranged downstream of the at least one condenser, and a divider arranged in a container interior of the container which may divide the container interior into a first sub-chamber and a second sub-chamber. The second sub-chamber may be Tillable with a coolant, which is introducible into the at least one condenser fluidically separately from the working fluid via a fluid line, such that the
(Continued)

working fluid is condensable via thermal interaction with the coolant.

20 Claims, 3 Drawing Sheets

(51) Int. Cl.

| | |
|---|---|
| ***F01K 9/02*** | (2006.01) |
| ***F01K 13/00*** | (2006.01) |
| ***F01K 23/14*** | (2006.01) |
| ***F01K 9/00*** | (2006.01) |
| ***F01K 23/06*** | (2006.01) |

(52) U.S. Cl.
CPC ..... *F01K 13/006* (2013.01); *F01K 23/065* (2013.01); *F01K 23/14* (2013.01)

(56) References Cited

FOREIGN PATENT DOCUMENTS

| | | | | | |
|---|---|---|---|---|---|
| DE | 102009050068 | A1 * | 4/2011 | ..... | F02G 5/00 |
| DE | 102009050068 | A1 | 4/2011 | | |
| DE | 102013211875 | A1 | 1/2015 | | |
| DE | 102014206038 | A1 | 10/2015 | | |
| EP | 2357324 | A2 | 8/2011 | | |
| WO | 2005001248 | A1 | 1/2005 | | |

OTHER PUBLICATIONS

English abstract for DE-10226445.
English abstract for DE-102009050068.
English abstract for DE-102013211875.

* cited by examiner

WASTE-HEAT RECOVERY SYSTEM

CROSS-REFERENCE TO RELATED APPLICATIONS

This application claims priority to International Patent Application No. PCT/EP2017/066740 filed Jul. 5, 2017, and German Patent Application No. DE 10 2016 212 232.0, filed Jul. 5, 2016, the contents of both of which are hereby incorporated by reference in their entirety.

TECHNICAL FIELD

The invention relates to a waste-heat recovery system.

BACKGROUND

Waste-heat recovery systems comprising a waste-heat recovery circuit can utilize for example the waste heat in an internal combustion engine in a motor vehicle. For this purpose, said waste heat is applied to a steam generator. The working fluid circulating in the steam circuit process is thereby heated, evaporated and overheated. The hot working fluid, which is under high pressure, is then expanded in an expansion machine and performs mechanical work, which can be used for instance as additional vehicle drive or to drive a generator or an air conditioning system.

The steam generator is typically formed by a heat exchanger, through which a working fluid can be guided to absorb heat.

In the expansion machine, for example an axial piston machine, the working fluid is expanded from the high first pressure level to a lower second pressure level by performing work. The pistons thereby drive a shaft, which serves for example to move a vehicle. The expanded fluid is cooled and liquefied in a condenser and is supplied to the fluid circuit again via a pump. The higher the pressure and temperature difference, the higher the efficiency of the unit.

Water can be used as working fluid, the steam of which is relaxed by outputting work. For example, organic working fluids or water comprising additives can be used as well, which may be valuable or harmful to the environment. An escape of the working fluid is then unwanted. A condenser arrangement located in the waste-heat recovery system downstream of the expansion machine serves to liquefy the expanded working fluid. Typical temperatures of the working fluid are several hundred ° C. for the energy-rich steam state and in the case of water 100° C. as condensation temperature. The condensed working fluid is supplied to a working fluid reservoir, typically in the form of a suitably realized container, which is present in the waste-heat recovery circuit, where it is available again for the waste-heat recovery circuit without losses.

In this context, DE 10226445 C1 as well as WO 2005/001248 A1 disclose conventional waste-heat recovery circuits. Feed water is used as working fluid. The water is evaporated in an evaporator. The steam is expanded by performing work in an expansion machine. After the expansion, the steam is condensed in a condenser and is supplied by means of an electrically or mechanically operated pump to a reservoir, from which it is available for the circuit again. The described working machine is used for example as auxiliary device in motor vehicles. To also use it in the winter, it is known to add antifreeze to the working fluid. It is further known to add lubricant, for instance oil, to the working fluid. Depending on the temperature in the steam generator, organic working fluids, comprising a lower boiling point and/or combustible working fluids are used as well.

The described arrangements can overheat, when for example too much heat is supplied to the steam circuit process. The components of the waste-heat recovery circuit may then be damaged.

SUMMARY

It is thus an object of the present invention to create an improved embodiment for a waste-heat recovery system comprising a waste-heat recovery circuit, which has an improved protection against overheating and overpressure when the cooling circuit fails.

This object is solved according to the invention by means of the subject matter of the independent patent claim(s). Advantageous embodiments are the subject matter of the dependent patent claim(s).

It is thus the general idea of the invention to guide a coolant stored in a container via a fluid line into the condenser of the waste-heat recovery circuit. According to the invention, the container is thereby constructed in such a way that two sub-chambers, which are fluidically separated from one another, are provided in said container, wherein a first sub-chamber is fluidically connected to the actual waste-heat recovery circuit and can thus be filled with the working fluid of the waste-heat recovery circuit. The coolant is located in the second sub-chamber. The two sub-chambers are embodied in a volume-variable manner, namely in such a way that a volume decrease of the second sub-chamber is associated with a volume increase of the first sub-chamber, and vice versa. This can be realized for example in that the two sub-chambers are divided by means of a suitable divider made of a flexible material. A rising fluid pressure of the steam phase of the working fluid leads to an expansion of the first sub-chamber of the container, which is associated with a decrease of the volume of the second sub-chamber, such that the coolant is pushed out of said second sub-chamber and is guided via the fluid line into the condenser. The heat exchange with the working fluid taking place at that location has the result that the temperature thereof and thus also the fluid pressure thereof reduces again. However, it can at least be attained with such a feedback that the fluid pressure of the working fluid does not rise even further and takes on inadmissible values, which could lead to damages of individual components of the waste-heat recovery circuit.

In the case of the waste-heat recovery system according to the invention, a particularly effective cooling of the working fluid and thus an improved efficiency of the exhaust-heat recovery circuit is thus ensured on the one hand. However, it is simultaneously also ensured that damages to the condenser and thus to the entire waste-heat recovery circuit by overpressure or a temperature, which is too high, of the working fluid as well as of the coolant is avoided. As a result, a waste-heat recovery circuit with a high efficiency and also with a high operational safety can thus be created.

A waste-heat recovery system according to the invention comprises a waste-heat recovery circuit, in which a working fluid circulates and which is divided into a high pressure region and into a low pressure region. The waste-heat recovery system comprises a conveying device located in the waste-heat recovery circuit for driving the working fluid, a steam generator, which located in the high pressure region, for evaporating the working fluid, as well as an expansion machine for expanding the working fluid to the pressure of the low pressure region by performing work. At least one condenser for condensing the expanded working fluid is located in the low pressure region. According to the invention, a container is provided downstream of the condenser, in the container interior of which a divider is located, which divides the container interior into a first and a second sub-chamber of a variable volume. The first sub-chamber is thereby fluidically connected to the low pressure region of the waste-heat recovery circuit downstream of the condenser. The second sub-chamber of the container is filled or can be filled with a coolant. Said coolant can be introduced into the condenser, fluidically separately from the working fluid, via a fluid line of the waste-heat recovery system, such that the working fluid can be condensed by thermal interaction with the coolant in this way.

In the case of a preferred embodiment, the first sub-chamber is connected to the low pressure region of the waste-heat recovery system via a first pressure-relief valve. The first pressure-relief valve is thereby embodied in such a way that, in response to exceeding a predetermined first threshold pressure of the working fluid in the first pressure-relief valve, it releases a fluid connection between the first sub-chamber and the low pressure region for the flow-through with the working fluid. It is ensured in this way that the working fluid is introduced into the container only in the case of failure, thus at a fluid pressure, which is too high. The first pressure-relief valve can be embodied as non-return valve.

In the case of another preferred embodiment, the divider, for the embodiment as first pressure-relief valve, has a dividing membrane of a resilient material, which expands in response to exceeding the predetermined first threshold pressure of the working fluid, such that the working fluid can flow into the first sub-chamber and can be accommodated there. In the case of this alternative, the provision of a separate pressure-relief valve—for instance in the manner of a non-return valve—can be forgone, which reduces the production costs of the waste-heat recovery system.

In the case of a preferred embodiment, a second pressure-relief valve is further located in the fluid line. The second pressure-relief valve is embodied in such a way that, in response to exceeding a predetermined, second threshold pressure of the coolant in the second pressure-relief valve, it switches from a closed into an open state, thus opens, namely in such a way that the coolant can be discharged from the fluid line via a fluid outlet into the surroundings of the waste-heat recovery system. The second pressure-relief valve is designed in such a way that, in response to exceeding a second threshold pressure, the coolant can escape from the fluid line into the surroundings of the waste-heat recovery circuit. It is ensured in this way that in the case of a fluid pressure of the coolant, which is too high, in the fluid line or in the condenser, respectively, the latter is not damaged, but that a discharge of the coolant from the condenser can take place in order to reduce pressure.

In the case of a further preferred embodiment, the condenser is embodied as triple-flow condenser comprising three fluid paths. In the case of this alternative, a first fluid path is embodied for the flow-through with the working fluid. A second fluid path is embodied for the flow-through with the coolant, and a third fluid path is embodied for the flow-through with an additional coolant. The three fluid paths run fluidically separately from one another in the condenser and are thermally coupled to one another for the heat exchange between the working fluid and the two coolants. The working fluid can be cooled according to standard by means of the additional coolant in a nominal operating state of the waste-heat recovery system via the third fluid path. An additional cooling in the case of failure takes place by means of the coolant via the second fluid path. This alternative ensures an optimal cooling of the fluid both in the nominal operating state of the waste-heat recovery system and in the case of failure.

In the case of another preferred embodiment, the condenser is embodied as double-flow condenser comprising two fluid paths. In the case of this alternative, the first fluid path is embodied for the flow-through with the working fluid and the second fluid path for the flow-through with the coolant and, alternatively or additionally, for the flow-through with the additional coolant. The two fluid paths run fluidically separately from one another at least in the condenser and are thermally coupled to one another for the heat exchange between the working fluid and the coolant or the additional coolant, respectively.

In the case of an advantageous further development, the second fluid path is embodied for the simultaneous flow-through with the coolant and with the additional coolant. For this purpose, the fluid line outside of the condenser leads into the second fluid path, such that the coolant and the additional coolant can mix. The setup of the condenser can be kept simple in this way. In particular the provision of a technically more complex, triple-flow condenser or the provision of a separate additional condenser can be forgone. This has an advantageous effect on the production costs of the waste-heat recovery system.

In another advantageous further development, the second fluid path is embodied for the flow-through with the coolant. In the case of this alternative, a further, double-flow condenser comprising a first and a second fluid path is provided in the low pressure region. The first fluid path of this additional condenser is embodied for the flow-through with the working fluid and the second fluid path for the flow-through with the additional coolant. Due to the fact that the coolant and the additional coolant cannot mix even in the case of failure in the case of this alternative, maintenance of the waste-heat recovery system in the case of failure and a division of the two coolants associated therewith is not required.

The condenser can advantageously be located between the second pressure-relief valve and the container. In an alternative, the second pressure-relief valve can be located between the condenser and the container. Both alternatives require only very little installation space.

In the case of an advantageous further development, the divider is embodied as dividing membrane of a flexible, in particular of a resilient material. The variability of the two partial volumes, which is essential for the invention, can be realized in a technically simple and thus cost-efficient manner in this way.

In the case of a further advantageous further development, the divider has an expanded state, in which the first sub-chamber has a maximum volume and the second sub-chamber has a minimal volume. In the case of this alternative, the divider furthermore has a relaxed state, in which the first sub-chamber has a minimal volume and the second sub-chamber has a maximum volume. If the fluid pressure of the working fluid downstream of the condenser rises, the steam phase of the working fluid can flow into the first sub-chamber, whereby the divider is expanded, such that the first sub-chamber increases. The decrease of the second sub-chamber associated therewith has the result that the coolant is pushed out of the container into the fluid line and is guided via the latter into the condenser, where it can cool said working fluid by heat exchange therewith.

In the case of a further preferred embodiment, which can be combined with the above-described embodiments, a non-return valve is located fluidically parallel to the first pressure-relief valve, which non-return valve makes it possible for the working fluid to flow out of the container back into the waste-heat recovery circuit, when the coolant has escaped from the fluid line and when a predetermined third pressure of the working fluid has been exceeded in the container. Said non-return valve serves the purpose of making it possible to provide for the working fluid to flow out the container back into the waste-heat recovery circuit when coolant has escaped from the fluid line into the surroundings, thus in the case of "emptied" fluid line. In this scenario, it is thus not required to fill the waste-heat recovery circuit with further working fluid A.

Particularly preferably, the temperature difference between an evaporating temperature of the coolant and a condensation temperature of the working fluid is at least 30° C., preferably at least 80° C. A particularly high heat transfer between the working fluid and the coolant can be ensured in this way, which has an advantageous effect on the efficiency of the waste-heat recovery system.

The working fluid can advantageously be ethanol, acetone or cyclopentane and the first threshold pressure can be approximately 10 bar. In the case of a suitable determination of the first threshold pressure, it can be attained in this way that the working fluid condenses at approx. 150° C. The coolant advantageously comprises water and the second threshold pressure is between 1 bar and 1.5 bar. An evaporation of the cooling fluid, thus water, can take place at a temperature of between approx. 100° C. and 110° C. in this way.

Particularly advantageously, the coolant can contain glycol and/or salt. A particularly high antifreeze effect can be created by means of such an addition.

In the case of a further advantageous further development, a temporary storage of a variable volume for temporarily storing the working fluid is located in the waste-heat recovery circuit in the low pressure region.

Further important features and advantages of the invention follow from the subclaims, from the drawings, and from the corresponding figure description by means of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the description below, whereby identical reference numerals refer to identical or similar or functionally identical components.

BRIEF DESCRIPTION OF THE DRAWINGS

In each case schematically.

DETAILED DESCRIPTION

Figure 1:
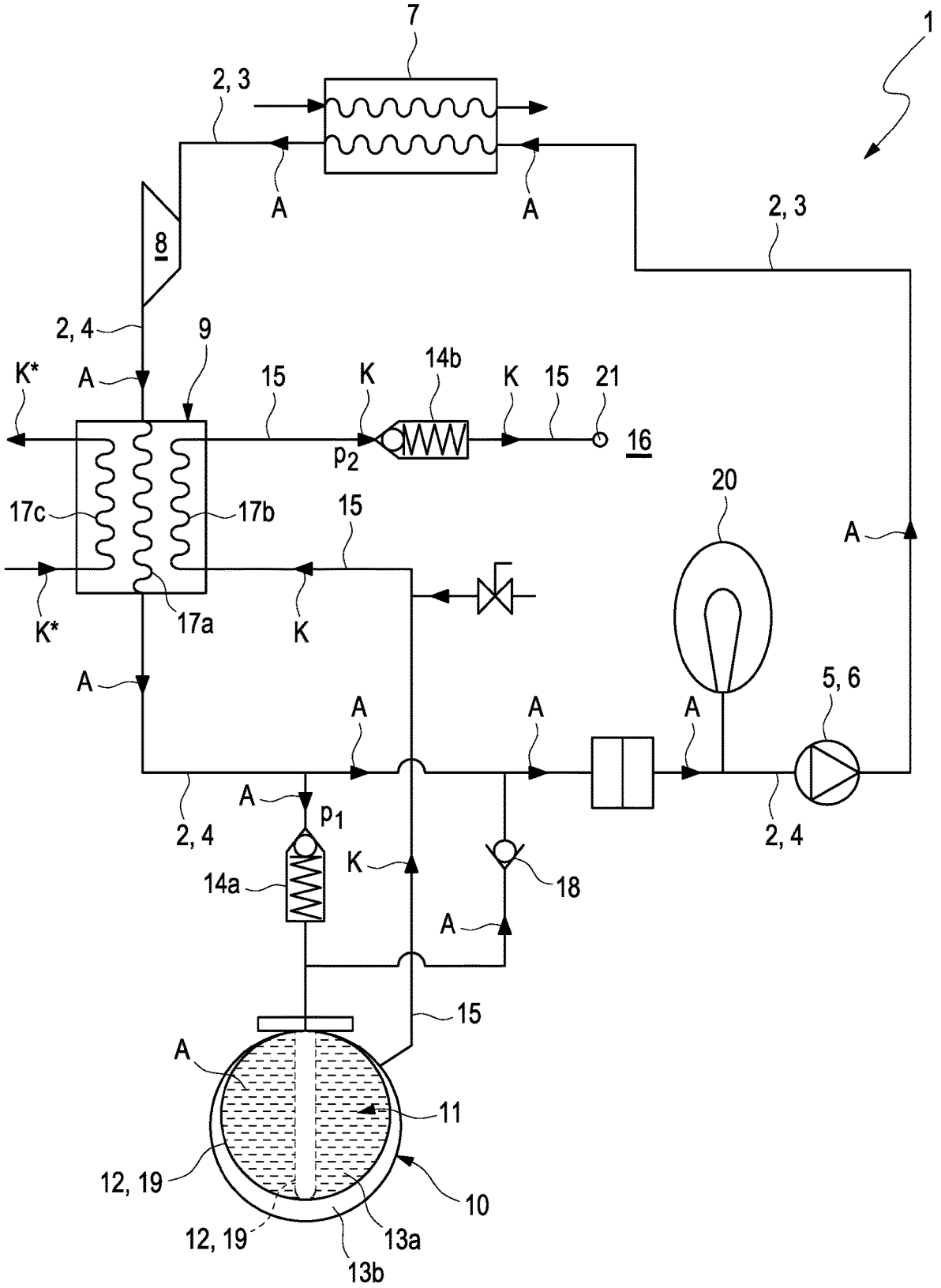
FIG. 1 shows an example of a waste-heat recovery system according to the invention comprising a triple-flow condenser in schematic illustration.

In schematic illustration, FIG. 1 shows an example of a waste-heat recovery system 1 according to the invention. The waste-heat recovery system 1 comprises a waste-heat recovery circuit 2, in which a working fluid A circulates and which is divided into a high pressure region 3 and into a low pressure region 4. In the waste-heat recovery circuit 2, a conveying device 5 in the form of a pump 6 is located, which serves to drive the working fluid A. A steam generator 7 for evaporating the working fluid A is furthermore located downstream of the conveying device 5, thus in the high pressure region 3. An expansion machine 8 for expanding the working fluid A by outputting mechanical work is located downstream of the steam generator 7. A condenser 9 for condensing the expanded working fluid A is located downstream of the expansion machine 9, thus in the low pressure region 4.

A container 10, in the container interior 11 of which a divider 12 is provided, is located downstream of the condenser 9 in the low pressure region 4. Said divider 12 divides the container interior 11 in a fluid-tight manner into a first and a second sub-chamber 13*a*, 13*b*, each of a variable volume.

The already mentioned conveying device 6 is located downstream of the container 10, such that the waste-heat recovery circuit 2 is closed.

The divider 12 can be embodied as dividing membrane 19 of a flexible material. Preferably a resilient material. The divider 12, which is embodied as dividing membrane 19, can have an expanded state, which is shown in FIG. 1, in which the first sub-chamber 13*a* has a maximum volume and the second sub-chamber 13*b* has a minimal volume. However, the divider 12, which is embodied as dividing membrane 19, also has a relaxed state, in which the first sub-chamber 13*a* has a minimal volume and the second sub-chamber 13*b* has a maximum volume. For illustration purposes, the dividing member 19 or the divider 12, respectively, is suggested in FIG. 1 in dashed illustration in the relaxed state.

The first sub-chamber 13*a* is connected to the low pressure region 4 of the waste-heat recovery circuit 2 downstream of the condenser 9 via a first pressure-relief valve 14*a*. The first pressure-relief valve 14*a* is embodied in such a way that, when a predetermined first threshold pressure $p_1$ of the working fluid in the first pressure-relief valve 14*a* is exceeded, the latter switches from a closed state, in which a fluid connection for the working fluid A between the first sub-chamber and the low pressure region 4 is closed, into an open state. In the open state, the fluid connection between the first sub-chamber 13*a* and the low pressure region 4 is released for the flow-through with the working fluid A. If ethanol, acetone or cyclopentane is used as working fluid A, a value of approximately 10 bar can be selected as first threshold pressure $p_1$.

The second sub-chamber 13*b* of the container interior 11 is filled with a coolant K, which can be guided into the condenser 9 via a fluid line 15 fluidically separately from the working fluid. The working fluid A can be condensed in the condenser 9 by thermal interaction with the coolant K. Water, which can contain glycol or a salt, can be used as coolant K. The coolant K is thereby ideally selected in such a way that as much heat as possible can be discharged in response to the evaporation of said coolant.

As can further be seen in FIG. 1, a second pressure-relief valve 14*b* is located in the fluid line 15. The second pressure-relief valve 14*b* is embodied in such a way that, when a predetermined second threshold pressure $p_2$ of the coolant K in the second pressure-relief valve 14*b* is exceeded, the latter switches from a closed into an open state, such that the coolant K can be discharged from the fluid line 15 into the surroundings 16 of the waste-heat recovery system 1 via a fluid outlet 21. In an alternative, the second pressure-relief valve 14*b* can be forgone. In this case, the ambient pressure $p_2$ of the surroundings 16 takes over the valve function of the pressure-relief valve 14*b*.

If water with glycol or a salt is used as coolant K, as already proposed above, between 1 bar and 1.5 bar turns out to be particularly advisable as value for the second threshold pressure $p_2$.

In the example of FIG. 1, the condenser 9 is located between the second pressure-relief valve 14*b* and the container 10. In an alternative, which is not shown in the figures, the second pressure-relief valve 14*b* can, however, also be located between the condenser 9 and the container 10. In the example of FIG. 1, the condenser 9 is furthermore embodied for a simultaneous thermal interaction of the working fluid A with the coolant K from the container and with a further, additional coolant K*, for example with coolant water. The condenser 9 thus has three fluid paths 17*a*, 17*b*, 17*c*, which are fluidically separated from one another, for the working fluid, the coolant K introduced from the container 10 into the condenser 9 and said additional coolant K*.

As can further be gathered from FIG. 1, a non-return valve 18 can be located fluidically parallel to the first pressure-relief valve 14*a* between the container 10 and the waste-heat recovery circuit 2. Said non-return valve 18 serves the purpose of making is possible that the working fluid A can flow from the first sub-chamber 13*a* of the container 10 back into the waste-heat recovery circuit 2, when coolant K has escaped from the fluid line 15 into the surroundings 16, thus in the case of a quasi "emptied" fluid line 15.

In the case of this scenario, it is thus not required to fill the waste-heat recovery circuit 2 with further working fluid A. For this purpose, the non-return valve 18 opens in response to exceeding a predetermined, third pressure $p_3$ of the working fluid A in the container 10 and thus also in the non-return valve 18, such that it is made possible for the working fluid A to flow back into the actual waste-heat recovery circuit 1. A temporary storage 20 of a variable volume for temporarily storing the working fluid A can be located in the low pressure region 4 of the waste-heat recovery circuit 2. An arrangement of the temporary storage 20 as shown in FIG. 1 downstream of the container 10 or of the condenser 9, respectively, and upstream of the conveying device 5 is in particular conceivable.

The mode of the operation of the container 10 as well as of the two pressure-relief valves 14*a*, 14*b* in the waste-heat recovery system 2 is as follows:

If the fluid pressure of the working fluid A downstream of the condenser 9 rises beyond the first threshold pressure $p_1$, the first pressure-relief valve 14*a* opens and the working fluid A can flow into the first part 13*a* of the container in the form of steam. The divider 12 in the form of the dividing membrane 19 is expanded in this way, such that the volume of the first sub-chamber 13*a* increases and the volume of the second sub-chamber 13*b* is accordingly reduced by the same amount. The coolant K located in the second sub-chamber 13*b* is thereby pushed via the fluid line 15 into the condenser 9, where a heat exchange with the working fluid A takes place as well. The working fluid A is cooled in this way. Due to the different threshold pressures $p_1$, $p_2$ of the two pressure-relief valves 141, 14*b*, working fluid A, which is now liquid, continues to flow into the first sub-chamber 13*a* and continues to displace the coolant K from the second sub-chamber 13*b*. The condensation of the working fluid A in the condenser 9 still ensured in this way. If the coolant K in the second pressure-relief valve 14*b* exceeds the second threshold pressure $p_2$, the second pressure-relief valve 14*b* opens and the coolant K can escape into the surroundings 16 of the waste-heat recovery circuit 2. Damages to the waste-heat recovery circuit 2 and in particular to the condenser 9 is avoided in this way.

Due to the fact that the second pressure-relief valve 14*b* opens at a threshold pressure $p_2$ in the pressure region between 1 bar and 1.5 bar, when the coolant is water, an evaporation of the water takes place at approximately 100° C. to 110° C. in the example scenario, an evaporation of the water takes place at approximately 100° C. to 110° C. when the coolant is water.

Due to the fact that evaporation enthalpy is required for evaporating the coolant, a small mass of coolant K can absorb a relative large amount of heat, so that relatively little coolant K has to be stored in the condenser 9 or in the container 10, respectively. Due to the fact that the first threshold pressure $p_1$ of the first pressure-relief valve 14*a* is approximately 10 bar, it can be attained that, when using ethanol, acetone or cyclopentane as working fluid A, the latter condenses at 150° C., while, as already described, the coolant K evaporates at approximately 100° C. to 110° C. This driving temperature difference of an evaporation temperature of the coolant K and of a condensation temperature of the working fluid A leads to a better heat transfer between working fluid A and coolant K and thus to an improved efficiency of the condenser 9 and thus of the entire waste-heat recovery circuit 2.

The working fluid A and the coolant K are preferably selected in such a way and the two threshold pressures $p_1$, $p_2$ are determined in such a way that said temperature difference between an evaporation temperature of the coolant K and a condensation temperature of the working fluid A is at least 30° C., preferably at least 80° C. A particularly high heat transfer between the working fluid A and the coolant K can be ensured in this way, which has an advantageous effect on the efficiency of the waste-heat recovery system 1 and which in particular increases the operational safety, because an overpressure can be reduced largely without danger in the system in response to a malfunction.

Figure 2:
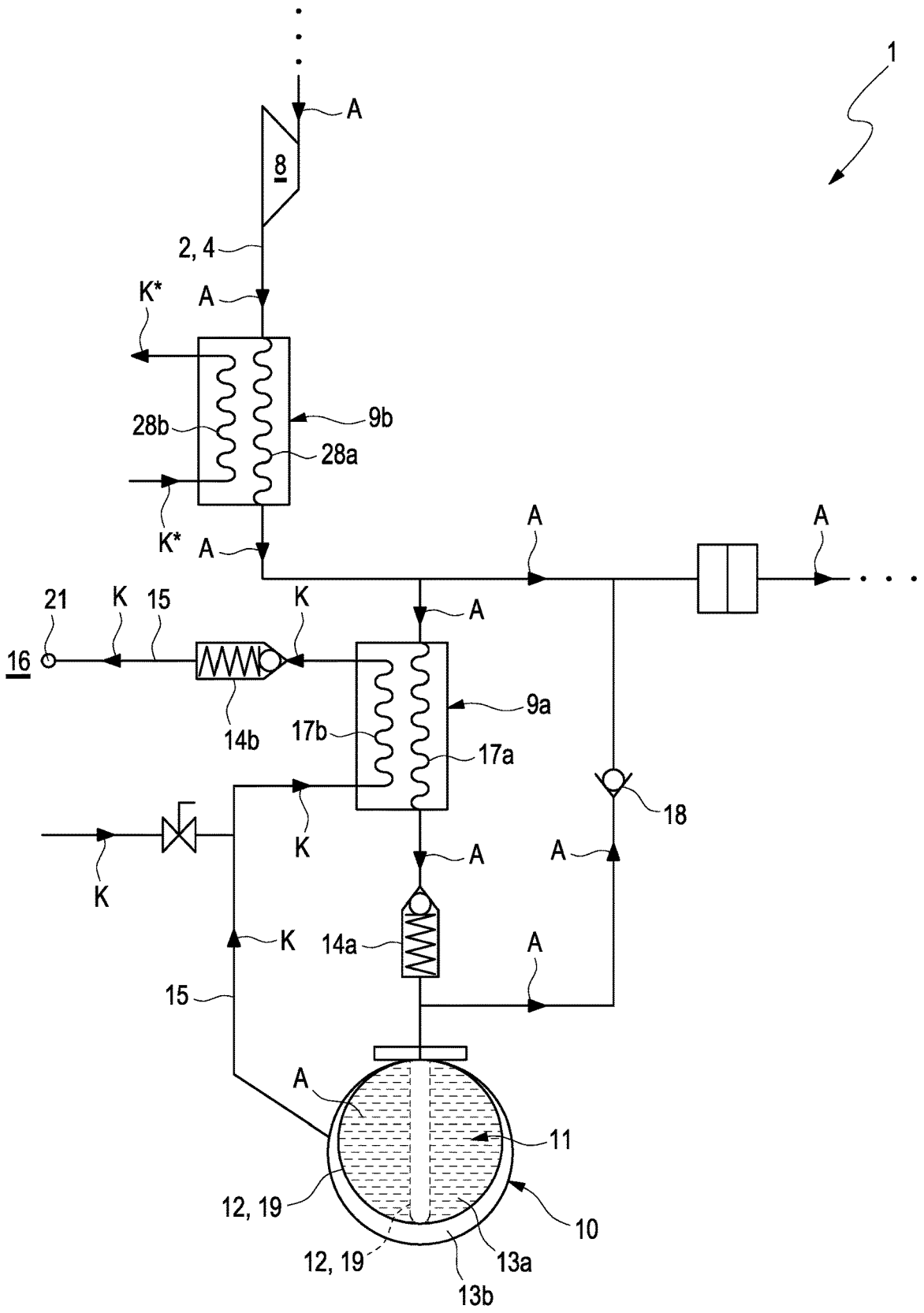
FIG. 2 shows a first alternative of the example of FIG. 1 comprising two double-flow condensers in a partial illustration.

FIG. 2 shows a first alternative of the waste-heat recovery system 1 of FIG. 1. In the example of FIG. 2, two condensers 9*a*, 9*b*, which are separated from one another, are located in the waste-heat recovery circuit 2 for condensing the working fluid A in the low pressure region 4. Both condensers 9*a*, 9*b* are realized as double-flow condensers. The condenser 9*a* has a first fluid path 17*a* for the flow-through with the working fluid A, and a second fluid path 17*b* for the flow-through with the coolant K. The two fluid paths 17*a*, 17*b* run fluidically separately from one another in the condenser 9*a*, but are thermally coupled to one another for the heat exchange between the working fluid A and the coolant K.

The additional condenser 9*b* has a first fluid path 28*a* for the flow-through with the working fluid A, and a second fluid path 28*b* for the flow-through with the additional coolant. The two fluid paths 28*a*, 28*b* run fluidically separately from one another in the condenser 9*b*, but are thermally coupled to one another for the heat exchange between the working fluid A and the additional coolant K*. The first condenser 9*a* serves to cool the working fluid A in the case of failure, thus in the case of a fluid pressure of the working fluid A, which is too high, due to insufficient cooling. The additional condenser 9*b* also cools the working fluid A during the nominal operation of the waste-heat recovery system 1, thus when no failure is at hand.

Figure 3:
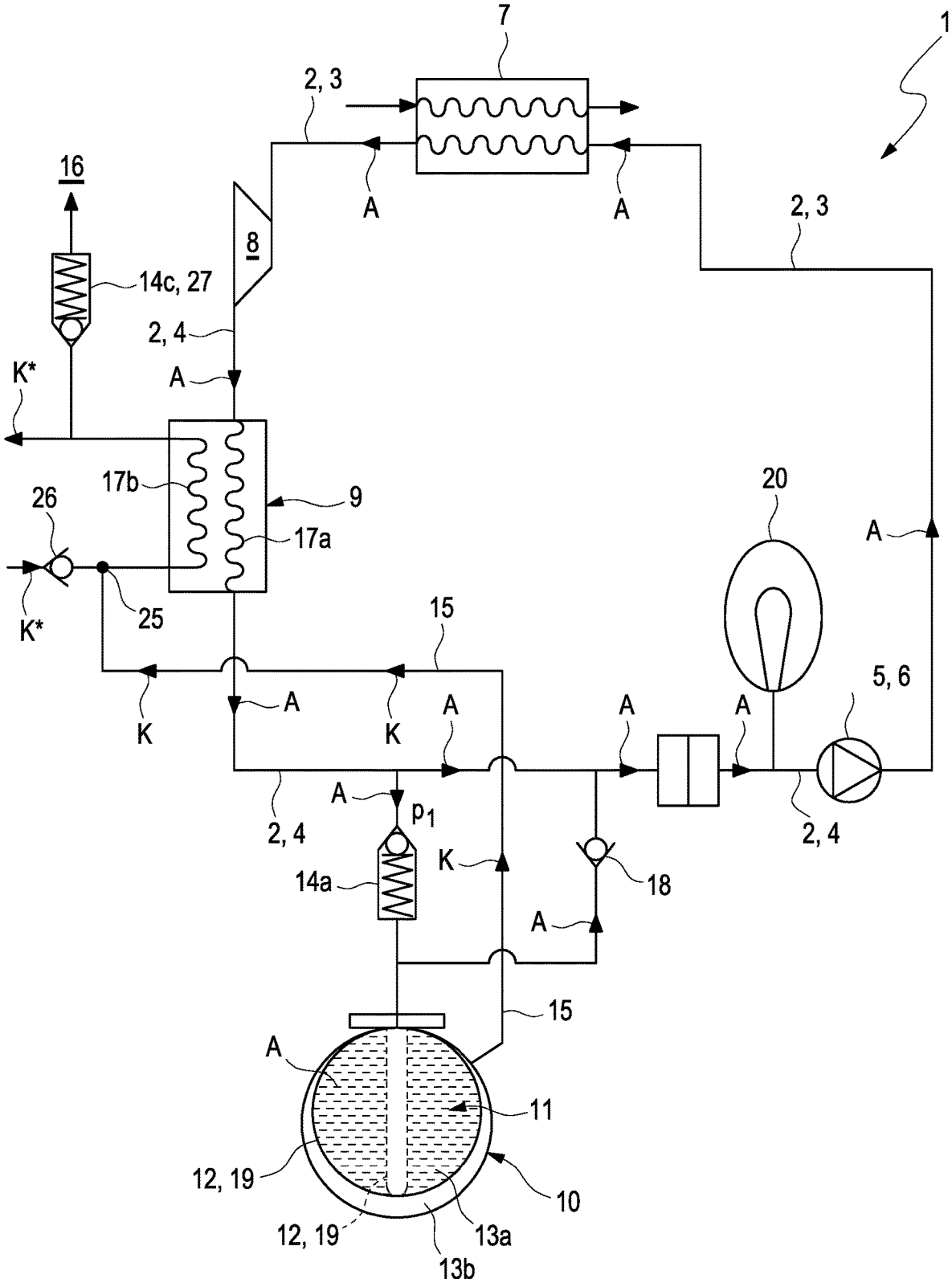
FIG. 3 shows a second alternative of the example of FIG. 1 comprising only one double-flow condenser.

FIG. 3 shows a second alternative of the waste-heat recovery system 1 of FIG. 1. In the example of FIG. 3—as well as in the example of FIG. 1—the condenser 9 is embodied for a simultaneous thermal interaction of the working fluid A with the coolant K from the container 10 as well as with the further, additional coolant K*, for example with coolant water. However, the condenser 9 only has two—and not three—fluid paths 17*a*, 17*b*. The fluid path 17*a* serves for the flow-through with the working fluid A. The fluid path 17*b* generally serves for the flow-through with the additional coolant K* in the nominal operation of the waste-heat recovery system 1.

The waste-heat recovery system 1 of FIG. 3 differs from the waste-heat recovery system 1 of FIG. 1 in that the fluid line 15 leads into the second fluid path 17*b* at an outlet point 25, i.e. the second sub-chamber 13*b* and the fluid path 17*b* are fluidically connected. In the case of failure, the coolant K is thus pushed out of the container 10 into the second fluid path 17 by means of the additional coolant K*. By means of a non-return valve 26 located in the fluid path 17*b*, it is ensured that the coolant K flows into the fluid path 17*b* in the flow direction of the additional coolant K*. A (third) pressure-relief valve 14*c* located in the fluid path 17*b* opens when a predetermined third threshold pressure $p_3$ is exceeded, such that the mixture of coolant K and additional coolant K* can be discharged into the surroundings 16 analogously to the examples of FIGS. 1 and 2. The third threshold pressure $p_3$ has to thereby be larger than the working pressure of the additional coolant K* in the nominal operating state of the waste-heat recovery system 1. The third pressure-relief valve 14*c* can be embodied as non-return valve 27.

A mixing of the coolant K with the coolant K* is accepted in the case of the alternative of FIG. 3, because a maintenance of the entire waste-heat recovery system 1 needs to be carried out in any event, when said failure occurs. In contrast to the waste-heat recovery system 1 of FIG. 1, the waste-heat recovery system 1 according to FIG. 3 has the advantage that the (second) condenser 9*b* can be forgone.

In an alternative of FIGS. 1 to 3, the first pressure-relief valve 14*a* can in each case be forgone. In the case of this alternative, the divider 12 acts as pressure-relief valve. For this purpose, it comprises a dividing membrane 19 of a resilient material, which expands when the predetermined first threshold pressure $p_1$ of the working fluid A is exceeded, such that the working fluid A can then flow into the first sub-chamber 13*a*.

The invention claimed is:

1. A waste-heat recovery system comprising:

a waste-heat recovery circuit in which a working fluid is circulatable and which has a high pressure region and a low pressure region;

a conveying device arranged in the waste-heat recovery circuit configured to drive the working fluid;

a steam generator arranged in the high pressure region of the waste-heat recovery circuit configured to evaporate the working fluid;

an expansion machine configured to expand the working fluid via mechanical work;

at least one condenser arranged in the low pressure region of the waste-heat recovery circuit configured to condense the working fluid expanded via the expansion machine;

a container arranged downstream of the at least one condenser; and a divider arranged in a container interior of the container, the divider dividing the container interior into a first sub-chamber and a second sub-chamber, each having a variable volume;

wherein the first sub-chamber is fluidically connected to the low pressure region of the waste-heat recovery circuit downstream of the at least one condenser; and wherein the second sub-chamber is fillable with a coolant, which is introducible into the at least one condenser fluidically separately from the working fluid via a fluid line, such that the working fluid is condensable via thermal interaction with the coolant.

2. The waste-heat recovery system according to claim 1, wherein:

the first sub-chamber is fluidically connected to the low pressure region of the waste-heat recovery circuit via a first pressure-relief valve; and the first pressure-relief valve is configured to open and release a fluid connection between the first sub-chamber and the low pressure region of the waste-heat recovery circuit when a pressure of the working fluid in the first pressure-relief valve exceeds a predetermined first threshold pressure.

3. The waste-heat recovery system according to claim 2, wherein the divider includes a dividing membrane composed of a resilient material configured to expand when the pressure of the working fluid in the first pressure-relief valve exceeds the predetermined first threshold pressure such that the working fluid is flowable into the first sub-chamber and is accommodatable in the first sub-chamber.

4. The waste-heat recovery system according to claim 2, further comprising a second pressure-relief valve arranged in the fluid line configured to open, when a pressure of the coolant in the second pressure-relief valve exceeds a predetermined second threshold pressure, such that the coolant is dischargeable from the fluid line via a fluid outlet into a surroundings of the waste-heat recovery system.

5. The waste-heat recovery system according to claim 1, wherein:

the at least one condenser is structured as a triple-flow condenser including three fluid paths;

the working fluid is flowable through a first fluid path of the three fluid paths, the coolant is flowable through a second fluid path of the three fluid paths, and an additional coolant is flowable through a third fluid path of the three fluid paths; and the three fluid paths respectively extend fluidically separately from one another in the at least one condenser and are thermally coupled to one another such that heat is exchangeable between the working fluid and the coolant and the additional coolants.

6. The waste-heat recovery system according to claim 1, wherein:

the at least one condenser is structured as a double-flow condenser including two fluid paths;

the working fluid is flowable through a first fluid path of the two fluid paths and at least one of the coolant and an additional coolant are flowable through a second fluid path of the two fluid paths; and the two fluid paths respectively extend fluidically separately from one another in the at least one condenser and are thermally coupled to one another such that heat is exchangeable between the working fluid and the at least one of the coolant and the additional coolant.

7. The waste-heat recovery system according to claim 6, wherein:

the at least one of the coolant and the additional coolant flowable through the second fluid path includes both the coolant and the additional coolant; and the fluid line, outside of the at least one condenser, leads into the second fluid path.

8. The waste-heat recovery system according to claim 6, wherein:

the at least one of the coolant and the additional coolant flowable through the second fluid path includes the coolant;

an additional double-flow condenser including an additional first fluid path and an additional second fluid path is arranged in the low pressure region of the waste-heat recovery circuit; and the working fluid is flowable through the additional first fluid path and the additional coolant is flowable through the additional second fluid path.

9. The waste-heat recovery system according to claim 4, further comprising a non-return valve arranged fluidically parallel to the second pressure-relief valve configured such that the working fluid is flowable out of the container and back into the waste-heat recovery circuit when the coolant has escaped from the fluid line and when a pressure of the working fluid in the container exceeds a predetermined third pressure.

10. The waste-heat recovery system according to claim 1, wherein a temperature difference between an evaporating temperature of the coolant and a condensation temperature of the working fluid is at least 30° C.

11. The waste-heat recovery system according to claim 2, wherein the working fluid is at least one of ethanol, acetone, and cyclopentane and the predetermined first threshold pressure is approximately 10 bar.

12. The waste-heat recovery system according to claim 4, wherein the coolant includes water and the predetermined second threshold pressure is 1 bar to 1.5 bar.

13. The waste-heat recovery system according to claim 1, wherein the coolant includes at least one of glycol and salt.

14. The waste-heat recovery system according to claim 1, further comprising a temporary storage of a variable volume configured to temporarily store the working fluid arranged in the low pressure region of the waste-heat recovery circuit.

15. The waste-heat recovery system according to claim 1, wherein a temperature difference between an evaporating temperature of the coolant and a condensation temperature of the working fluid is at least 80° C.

16. The waste-heat recovery system according to claim 1, further comprising a fluid line pressure-relief valve arranged in the fluid line configured to open such that the coolant is dischargeable from the fluid line via a fluid outlet into a surroundings of the waste-heat recovery system when a pressure of the coolant in the fluid line pressure-relief valve exceeds a predetermined fluid line valve threshold pressure.

17. The waste-heat recovery system according to claim 16, further comprising a non-return valve arranged fluidically parallel to the fluid line pressure-relief valve configured such that the working fluid is flowable out of the container and back into the waste-heat recovery circuit when the coolant has escaped from the fluid line and a pressure of the working fluid in the container exceeds a predetermined container pressure.

18. A waste-heat recovery system comprising:

a waste-heat recovery circuit in which a working fluid is circulatable and which has a high pressure region and a low pressure region;

a conveying device arranged in the waste-heat recovery circuit configured to drive the working fluid;

a steam generator arranged in the high pressure region of the waste-heat recovery circuit configured to evaporate the working fluid;

an expansion machine configured to expand the working fluid via mechanical work;

at least one condenser arranged in the low pressure region of the waste-heat recovery circuit configured to condense the working fluid expanded via the expansion machine;

a container arranged downstream of the at least one condenser;

a divider arranged in a container interior of the container, the divider dividing the container interior into a first sub-chamber and a second sub-chamber each having a variable volume; and a temporary storage of a variable volume configured to temporarily store the working fluid arranged in the low pressure region of the waste-heat recovery circuit;

wherein the first sub-chamber is fluidically connected to the low pressure region of the waste-heat recovery circuit downstream of the at least one condenser via a first pressure-relief valve configured to open and release a fluid connection between the first sub-chamber and the low pressure region of the waste-heat recovery circuit when a pressure of the working fluid in the first pressure-relief valve exceeds a predetermined first threshold pressure; and wherein the second sub-chamber is fillable with a coolant, which is introducible into the at least one condenser fluidically separately from the working fluid via a fluid line, such that the working fluid is condensable via thermal interaction with the coolant.

19. The waste-heat recovery system according to claim 18, wherein the coolant includes water and at least one of glycol and salt.

20. A waste-heat recovery system comprising:

a waste-heat recovery circuit in which a working fluid is circulatable and which has a high pressure region and a low pressure region;

a conveying device arranged in the waste-heat recovery circuit configured to drive the working fluid;

a steam generator arranged in the high pressure region of the waste-heat recovery circuit configured to evaporate the working fluid;

an expansion machine configured to expand the working fluid via mechanical work;

at least one condenser arranged in the low pressure region of the waste-heat recovery circuit configured to condense the working fluid expanded via the expansion machine;

a container arranged downstream of the at least one condenser; and a divider arranged in a container interior of the container, the divider dividing the container interior into a first sub-chamber and a second sub-chamber each having a variable volume;

wherein the first sub-chamber is fluidically connected to the low pressure region of the waste-heat recovery circuit downstream of the at least one condenser;

wherein the second sub-chamber is fillable with a coolant, which is introducible into the at least one condenser fluidically separately from the working fluid via a fluid line, such that the working fluid is condensable via thermal interaction with the coolant; and wherein the divider includes a dividing membrane composed of a resilient material, the dividing membrane configured to expand such that the working fluid is flowable into the first sub-chamber and is accommodatable in the first sub-chamber when a pressure of the working fluid downstream of the at least one condenser exceeds a predetermined first threshold pressure.

* * * * *